US010670338B2

(12) United States Patent
Wingard, Jr. et al.

(10) Patent No.: US 10,670,338 B2
(45) Date of Patent: Jun. 2, 2020

(54) AGRICULTURAL DRYER WITH MIXED-FLOW FAN

(71) Applicant: The GSI Group LLC, Assumption, IL (US)

(72) Inventors: David R. Wingard, Jr., Decatur, IL (US); Jarod B. Wendt, Effingham, IL (US)

(73) Assignee: The GSI Group LLC, Assumption, IL (US)

( * ) Notice: Subject to any disclaimer, the term of this patent is extended or adjusted under 35 U.S.C. 154(b) by 0 days.

(21) Appl. No.: 16/092,061

(22) PCT Filed: May 12, 2017

(86) PCT No.: PCT/US2017/032350

§ 371 (c)(1),
(2) Date: Oct. 8, 2018

(87) PCT Pub. No.: WO2017/197229

PCT Pub. Date: Nov. 16, 2017

(65) Prior Publication Data

US 2019/0107326 A1 Apr. 11, 2019

Related U.S. Application Data

(60) Provisional application No. 62/335,152, filed on May 12, 2016, provisional application No. 62/428,637, filed on Dec. 1, 2016.

(51) Int. Cl.

| | |
|---|---|
| ***F26B 9/06*** | (2006.01) |
| ***F26B 21/00*** | (2006.01) |
| ***F26B 23/02*** | (2006.01) |

(52) U.S. Cl.

CPC ..... *F26B 9/063* (2013.01); *F26B 21/001* (2013.01); *F26B 23/02* (2013.01); *F26B 2200/06* (2013.01)

(58) Field of Classification Search

CPC ..... F26B 9/063; F26B 21/00; F26B 21/001; F26B 23/02; F26B 2200/06

(Continued)

(56) References Cited

U.S. PATENT DOCUMENTS 395,689 A * 1/1889 Anonymous ..... F26B 25/06 432/94
3,057,611 A * 10/1962 Bjerkan ..... F26B 21/001 432/222

(Continued)

FOREIGN PATENT DOCUMENTS

CA 3022168 A1 * 11/2017 ..... F26B 9/063
JP 2006 125721 A 5/2006
WO WO-2017197229 A1 * 11/2017 ..... F26B 9/063

OTHER PUBLICATIONS

UK Intellectual Property Office, International Search Report for related UK Application No. 1609885.7 dated Dec. 7, 2016.

(Continued)

*Primary Examiner* — Stephen M Gravini

(57) ABSTRACT

An agricultural dryer assembly has a fan apparatus and burner assembly that form a longitudinal dryer axis. An airflow transition mechanism is positioned between the fan apparatus and the burner assembly and has an endcap with an end plate that is substantially perpendicular to the dryer axis. A transition housing has an upstream end proximate the fan apparatus having a first diameter and a downstream end proximate the burner assembly having a second size, and an open middle. The airflow transition mechanism also includes an end plate perpendicular to the airflow and for a single burner configuration, a first and second air-directing crossing members and for a dual burner configuration, two inlet devices positioned in a middle opening of the transition housing that extend through the axis of the fan heater assembly.

17 Claims, 9 Drawing Sheets

(58) Field of Classification Search
USPC ..... 34/232
See application file for complete search history.

(56) References Cited

U.S. PATENT DOCUMENTS

| | | | | | |
|---|---|---|---|---|---|
| 3,586,301 | A * | 6/1971 | Shipp | A01D 43/003 | 432/222 |
| 3,794,461 | A | 2/1974 | Brazee | | |
| 3,894,526 | A | 7/1975 | Kofink | | |
| 3,982,329 | A * | 9/1976 | Dougherty | F26B 3/06 | 34/443 |
| 4,249,891 | A * | 2/1981 | Noyes | F26B 17/122 | 34/171 |
| 4,267,645 | A * | 5/1981 | Hill | A24B 1/02 | 34/213 |
| 4,295,822 | A * | 10/1981 | Campbell | F23G 7/10 | 110/204 |
| 4,509,273 | A * | 4/1985 | Roisen | A01D 41/133 | 110/227 |
| 5,105,563 | A * | 4/1992 | Fingerson | A01D 43/003 | 34/203 |
| 5,651,193 | A | 7/1997 | Rhodes et al. | | |
| 5,893,218 | A * | 4/1999 | Hunter | F26B 9/063 | 34/168 |
| 6,085,443 | A * | 7/2000 | Hunter | F26B 21/00 | 34/174 |
| 6,209,223 | B1 * | 4/2001 | Dinh | F26B 17/1416 | 34/167 |
| 6,230,419 | B1 * | 5/2001 | Hinter | F26B 21/00 | 34/381 |
| 8,561,315 | B2 * | 10/2013 | Thompson | F26B 9/063 | 34/93 |
| 8,726,539 | B2 * | 5/2014 | Potter | F26B 9/02 | 165/54 |
| 8,973,285 | B2 * | 3/2015 | Fujitomo | F26B 23/022 | 110/238 |
| 9,140,495 | B2 * | 9/2015 | Ferrell | B30B 11/225 | |
| 9,714,790 | B2 * | 7/2017 | Bartosik | F26B 21/08 | |
| 9,835,375 | B2 * | 12/2017 | Bloemendaal | F26B 17/12 | |
| 9,863,703 | B2 * | 1/2018 | Morrison | F26B 17/12 | |
| 2008/0155985 | A1 * | 7/2008 | Labrador | F01K 27/00 | 60/698 |
| 2010/0229421 | A1 | 9/2010 | Salisbury | | |
| 2012/0011736 | A1 | 1/2012 | Morrison et al. | | |
| 2015/0260455 | A1 * | 9/2015 | Lallouet | F26B 21/003 | 34/480 |
| 2018/0148389 | A1 * | 5/2018 | Wang | F22B 1/1861 | |
| 2019/0107326 | A1 * | 4/2019 | Wingard, Jr. | F26B 9/063 | |

OTHER PUBLICATIONS

European Patent Office, International Search Report for related International Patent Application No. PCT/US2017/032350, dated Oct. 4, 2017.

* cited by examiner

AGRICULTURAL DRYER WITH MIXED-FLOW FAN

BACKGROUND OF THE INVENTION

Field of Invention

This invention relates generally to agricultural dryers, and more particularly to an agricultural dryer with a single mixed flow fan having an airflow transition mechanism providing a more even velocity distribution of the airflow and serving one or more burners.

Description of Related Art

Grains such as wheat, corn, soybean, and other agricultural products such as nuts, often need to be dried after harvesting to achieve a final moisture content adequate to inhibit microbial growth and preserve the value of the product during storage. Agricultural dryers allow farmers to start harvesting earlier at higher moisture levels and to dry the harvest in bins to more optimal moisture content, increasing yields and improving profits. This allows the farmer to minimize weather risks, reduce dry matter loses, and reduce head shatter loss. Drying involves the reduction of moisture from about 17-30% w/w to values between 8 and 15% w/w, depending on the harvested product.

Drying the products includes directing an air flow through one or more burners to heat the air and then directing the heated airflow through the product storage bin. Systems with two or more burners generally have a fan for each burner and an internal divider between each fan, so each fan blows into its own burner and downstream duct or plenum and is not affected by the other. This configuration allows a two burner dryer to dry in full-heat mode, where it may run very hot on the top chamber and cooler on the bottom chamber, and also to be run in a heat/cool mode where all the drying is done in the top chamber and the burner is turned off in the bottom chamber which supplies ambient air for cooling the products. Fans and burners on most traditional dryers are mounted on the same end of a dryer assembly; however, they may be mounted in a staggered configuration on opposite ends of a dryer assembly to deliver more uniform heat for a higher quality, more evenly dried product at lower cost and higher efficiency. The primary advantage of a multiple burner system, no matter how configured, is the flexibility they provide to manage varying qualities of incoming products to meet outgoing product specifications.

Typically, either an axial fan or a centrifugal fan is used to generate the requisite air flow. Vane axial fans provide a more even air velocity distribution across the burner. However, vane axial fans have the undesirable characteristic that they can be quite loud. Centrifugal fans are quieter than vane axial fans, but centrifugal fans produce an uneven velocity distribution resulting in a poor heat mix. It would be desirable to have an improved agricultural dryer that provides a desirable velocity distribution while generating less noise and consuming less energy.

OVERVIEW OF THE INVENTION

In one aspect, the invention is directed to an agricultural dryer assembly for directing heated air through a product storage bin. The agricultural dryer assembly includes a fan apparatus configured to produce an airflow, the fan apparatus having a cylindrical outer fan housing. The agricultural dryer assembly includes a burner assembly having one or more burners each burner with a cylindrical burner housing, the burner housing having a diameter that is smaller than a diameter of the fan housing. The fan apparatus and burner assembly forming a longitudinal dryer axis extending from a first end to a second end of the dryer. In one aspect, the fan apparatus is a mixed-flow fan.

The dryer assembly also includes an airflow transition mechanism positioned between the fan apparatus and the burner assembly configured to direct the airflow to the burner and to a downstream duct or dryer plenum. The airflow transition mechanism includes an endcap positioned on a distal end of the bearing tube, the endcap having a sloped ring and an end plate, wherein the endplate has a planer surface facing the burner assembly end plate that is substantially perpendicular to the axis of the dryer assembly and has a diameter smaller than an outer diameter of the bearing tube. In one embodiment, the airflow transition mechanism includes a transition housing extending between the outer fan housing of the mixed flow fan and the burner housing of a single burner assembly, the transition housing having an upstream end proximate the mixed-flow fan having a first diameter and a downstream end proximate the burner assembly having a second diameter, with the upstream diameter being larger than the downstream diameter, the transition housing having a substantially open middle for directing the airflow. In this embodiment, the airflow transition mechanism also includes a first air-directing crossing member and a second air-directing crossing member. The first and second air-directing crossing members are positioned in the middle opening of the transition housing and extend through the axis of the dryer assembly.

In a second embodiment, the dryer assembly includes a burner assembly having two burners, each burner with a cylindrical housing smaller than the diameter of the fan housing. In this duel burner configuration, the downstream end of the airflow transition housing has a rectangular shape to accommodate the diameter of both burners of the burner assembly. In this aspect, the airflow transition mechanism includes a housing end plate with a planer surface directed towards the burner assembly and substantially perpendicular to the axis of the dryer assembly. The transition housing end plate has two inlets attached to the planer surface facing the fan apparatus and two burner housings attached to the planer surface facing the burner assembly. The amount of airflow directed to each of the burner housings is dependent on the diameter of the inlets and burner housings.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications, configurations and equivalents as will become apparent from consideration of the following detailed description.

Figure 1A:
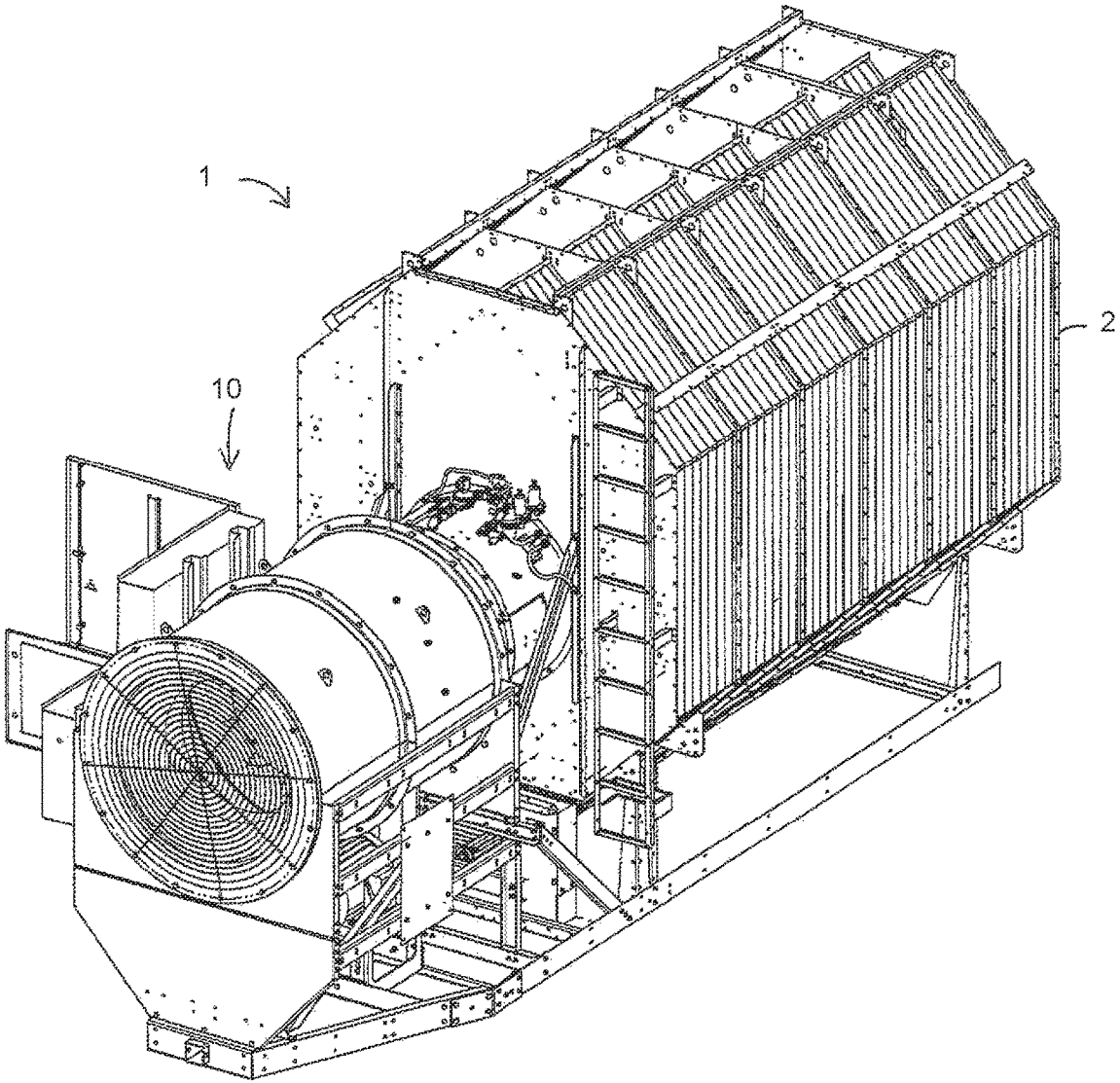
FIG. 1A is an isometric view of a single burner agricultural dryer system embodying the present invention.

Referring now to FIG. 1A, an example agricultural dryer system 1 having a dryer assembly 10 is shown. The dryer assembly 10 provides means for directing heated air through a product storage bin 2 of the dryer 1. As shown, the dryer assembly 10 includes a fan apparatus 12, an airflow transition mechanism 14, and a burner assembly 16 laid out along dryer axis D from a first end 18 to a second end 19. Air is taken into the dryer assembly 10 at the first end 18 by the fan apparatus 12 and directed out the second end 19 after passing through the burner assembly 16. As is known in the art, the dryer assembly 10 provides a heated airflow for the agricultural dryer system 1 to reduce the moisture content in the agricultural products contained in the storage bin 2.

In the illustrated embodiments, the fan apparatus 12 is of the type conventionally known as a mixed-flow fan which shares characteristics of both centrifugal and axial type fans. As is known to those skilled in the art, mixed-flow fans combine the benefits of axial flow and centrifugal flow fans. The mixed-flow fan 12 includes a generally cylindrical outer housing 20. As better seen in FIGS. 2A, 2B and 3A, 3B in the illustrated embodiments the housing 20 comprises a first can 22 and a second can 24. The first can 22 is shown as being provided with a first flange 26 and a second flange 28 and the second can 24 is provided with a third flange 30 and a forth flange 32 with the second and third flanges 28, 30 attached together with suitable fasteners 33. The flanges 26 and 32 are for allowing the dryer assembly 10 to be connected to ducting systems or other equipment of a product storage system. First flange 26 is also shown as being configured to accept a bell inlet 34 which serves the purpose of guiding air into a fan wheel (not shown) of the mixed-flow fan 12. The bell inlet 34 is desirably covered by a suitable grill 35 to prevent debris from being sucked into the mixed-flow fan 12. In the embodiments shown, the housing 20 is formed by rolling the ends of the sheet from which the housing 20 is formed with the ends joined together at the seam line by a welding process.

The second can 24 houses a cylindrical bearing tube 36. The bearing tube 36 receives a shaft 38 along portion of the axis D of the dryer assembly 10. The fan wheel is mounted to the shaft 38 and driven by an external drive motor (not shown) through a suitable belt drive configuration 40 wherein the shaft 38 is coupled to the external drive motor such that the drive motor can drive the fan wheel as would be understood by one skilled in the art. The shaft 38 is provided with necessary bearings using sound engineering judgment. As the fan wheel rotates, air is directed from an inlet end 42 to an outlet end 44. As shown, the mixed-flow fan 12 includes a plurality of airfoil-shaped straightener vanes 46 extending from an outer surface of the bearing tube 36 toward the outer housing 20 that operate to straighten the airflow after the air has passed through the fan wheel. As the mixed-flow fan 12 may be of any conventional design, further discussion of the mixed-flow fan 12 is not required herein.

The burner assembly 16 of the dryer assembly 10 may be comprised of one or more burners and receives the airflow generated by the mixed-flow fan 12 and provides the heated airflow to a product storage system 2. The burner assembly 16 in one embodiment is comprised of one burner 60A and a burner housing 62A. The burner 60A may be of any conventional design and need not be discussed further herein. In one embodiment, the burner 60A is of the type conventionally known as a star fire burner. In one embodiment, the burner housing 62A is cylindrical and has a diameter that is smaller than a diameter of the fan housing 20. The burner housing 62A is shown as being provided with a fifth flange 64 and a sixth flange 66. The sixth flange 66 is for allowing the dryer assembly 10 to be connected to the ducting system or other equipment of the product storage system.

According to the invention, the dryer assembly 10 is provided with the airflow transition mechanism 14 between the mixed-flow fan 12 and the burner assembly 16 to produce a desired distribution of the airflow to the burner assembly 16. The transition mechanism 14 comprises an endcap 70 positioned on a distal end of the bearing tube 36. The endcap 70 comprises a sloped ring 72 and an end plate 74. Desirably, the end plate 74 has a planer surface 76 facing the burner assembly 16 and in one embodiment is circular with a diameter smaller than an outer diameter of the bearing tube 36. In this embodiment, desirably, the diameter of the end plate 74 is between about 60%-85 of the diameter of the bearing tube 36, and more desirably about 75%, with sides of the sloped ring 72 having an angle $\alpha$ of between about 45 and 75 degrees. In one embodiment, the endcap 70 transitions from a bearing tube diameter of about 33 inches (84 cm) down to an end plate diameter of about 25 inches (64 cm). The end plate 74 is substantially perpendicular to the axis D of the dryer assembly 10. In the illustrated embodiment of FIGS. 2A and 3A, the sloped ring 72 has a cutout 78 to allow for passage of drive belts for the belt drive configuration 40 into the bearing tube 36.

The transition mechanism 14 comprises a transition housing 80 extending between the outer housing 20 of the mixed flow fan 12 and the burner assembly 16. In an embodiment configured for a single burner 60A the transition housing 80 has an upstream end 82A proximate the mixed-flow fan 12 having a first diameter and a downstream end 84A proximate the burner assembly 16 having a second diameter, with the upstream diameter being larger than the downstream diameter such that the transition housing 80 is shaped as a truncated cone with a substantially open middle 86 for directing air from the mixed-flow fan 12 to the burner assembly 16. Desirably, the diameter of the downstream end 84A is between about 60%-85% of the diameter of the upstream end 82A, and more desirably about 78%, with transition housing 80 having an angle $\beta$ of between about 45 and 75 degrees. In one embodiment, the transition housing transitions between fan housing diameter of about 54 inches (137 cm) to a burner housing diameter of about 42 inches (107 cm). The transition housing 80 is shown as being provided with a seventh flange 88 and an eighth flange 90. The seventh flange 88 is connected to the fourth flange 32 of the second can 24 with suitable fasteners 33. The eighth flange 90 is connected to the fifth flange 64A of the burner housing 62A with suitable fasteners 33.

The transition mechanism 14 comprises a first air-directing crossing member 92 and a second air-directing crossing member 94 extending through the middle opening 86 of the transition housing 80. Desirably, the first and second crossing members 92, 94 are substantially planer members that extend through the axis D of the burner assembly 10. In the illustrated embodiment, the first crossing member 92 is perpendicular with the second crossing member 94 with the intersection 96 of the two crossing members 92, 94 being collinear with the axis D. Ends 98 of the first and second crossing members 92, 94 are spaced from the endplate 74 of the endcap 70 along the axis D to form a gap G. Desirably, gap G has a distance of between about 0.25-1.0 inches (0.6-2.5 cm).

Figure 1B:
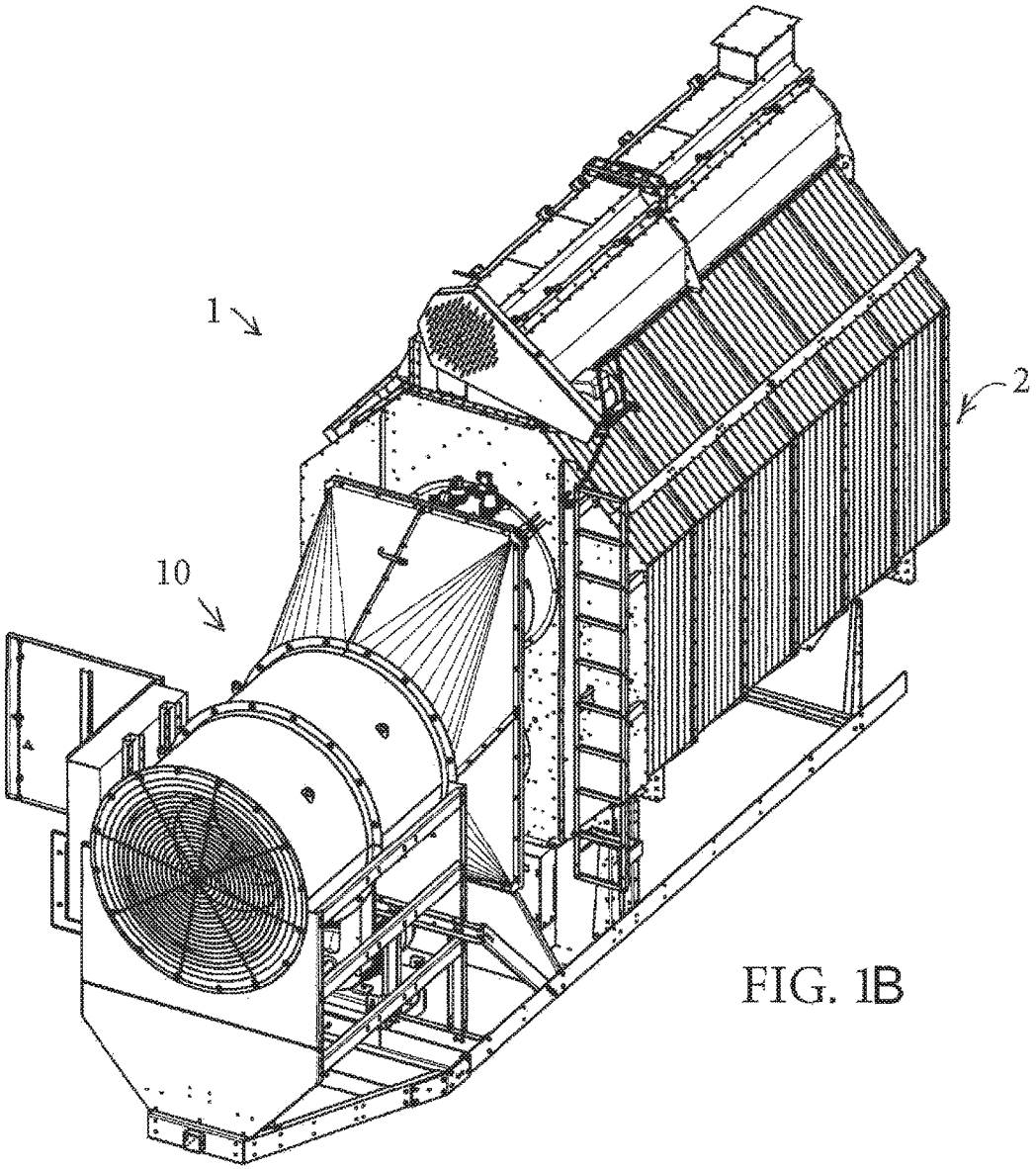
FIG. 1B is an isometric view of a dual burner agricultural dryer embodying the present invention.
Figure 1C:
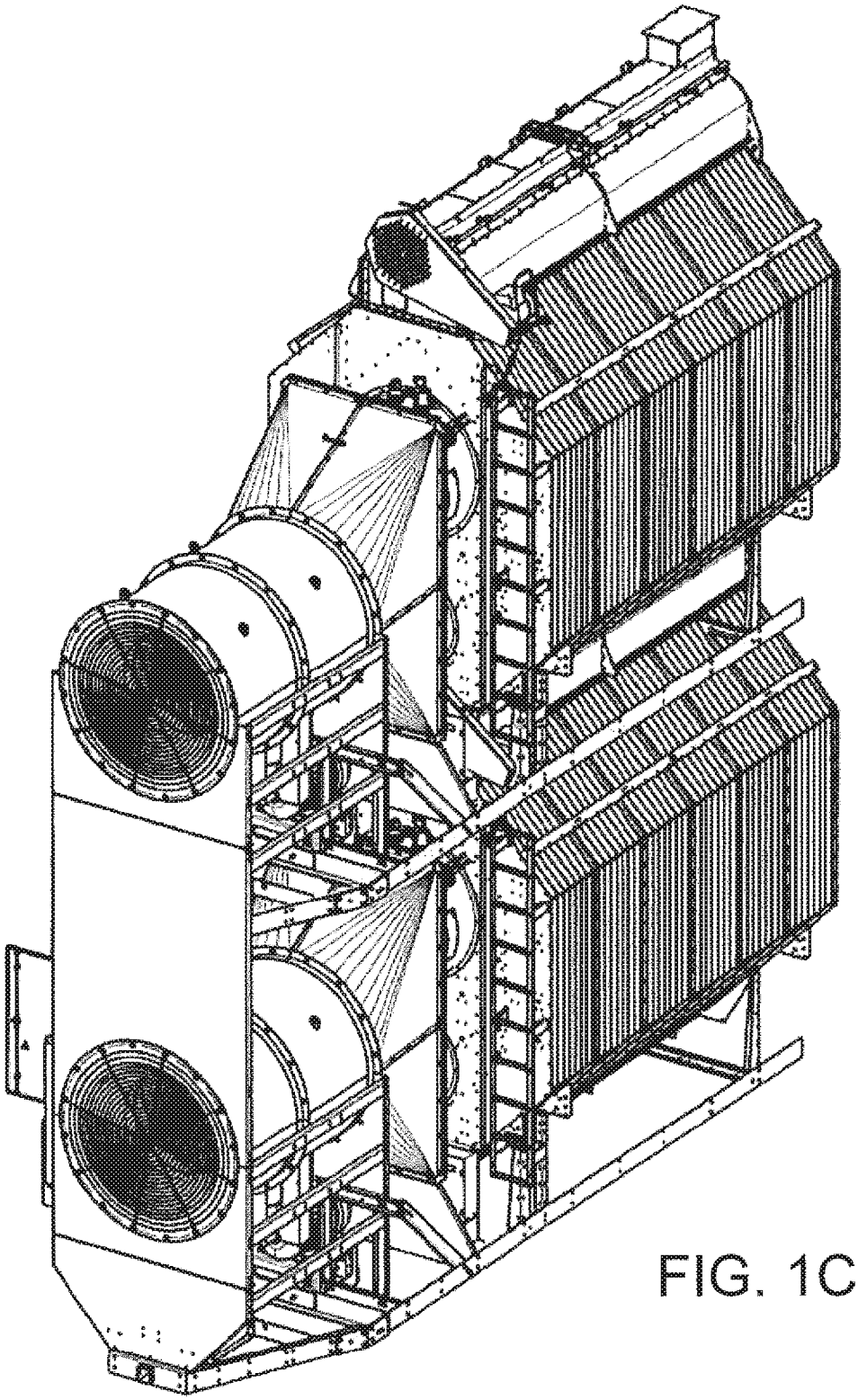
FIG. 1C is an isometric view of a stacked configuration of dual burner agricultural dryers embodying the present invention.
Figure 2A:
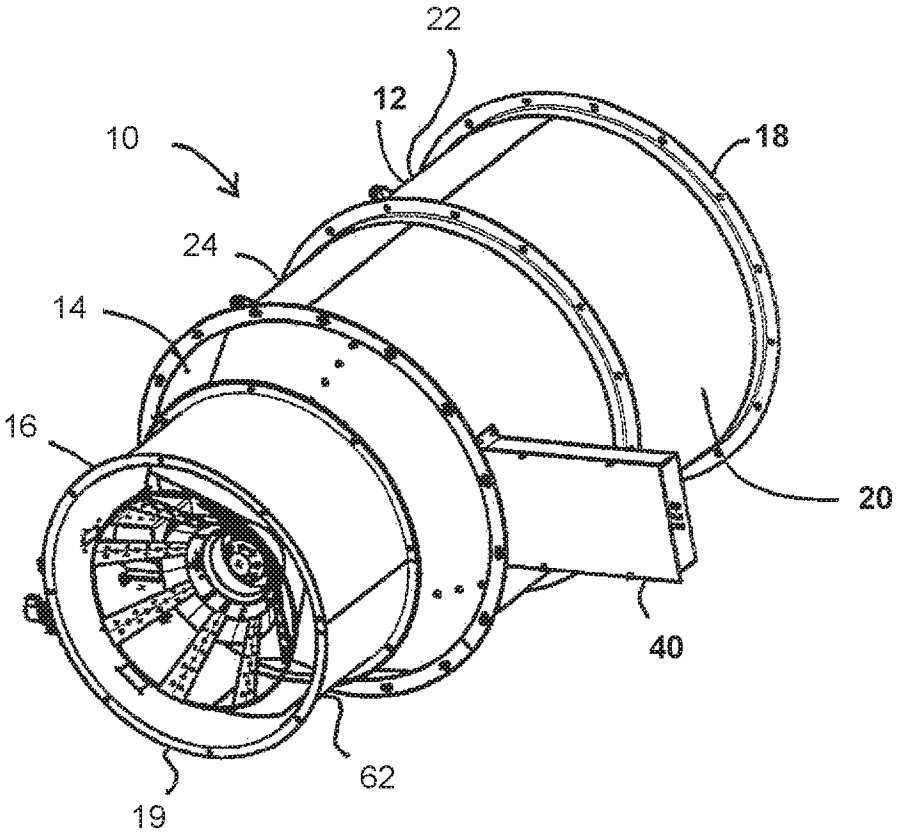
FIG. 2A is an isometric view of a single burner dryer assembly of the dryer system of FIG. 1A.
Figure 2B:
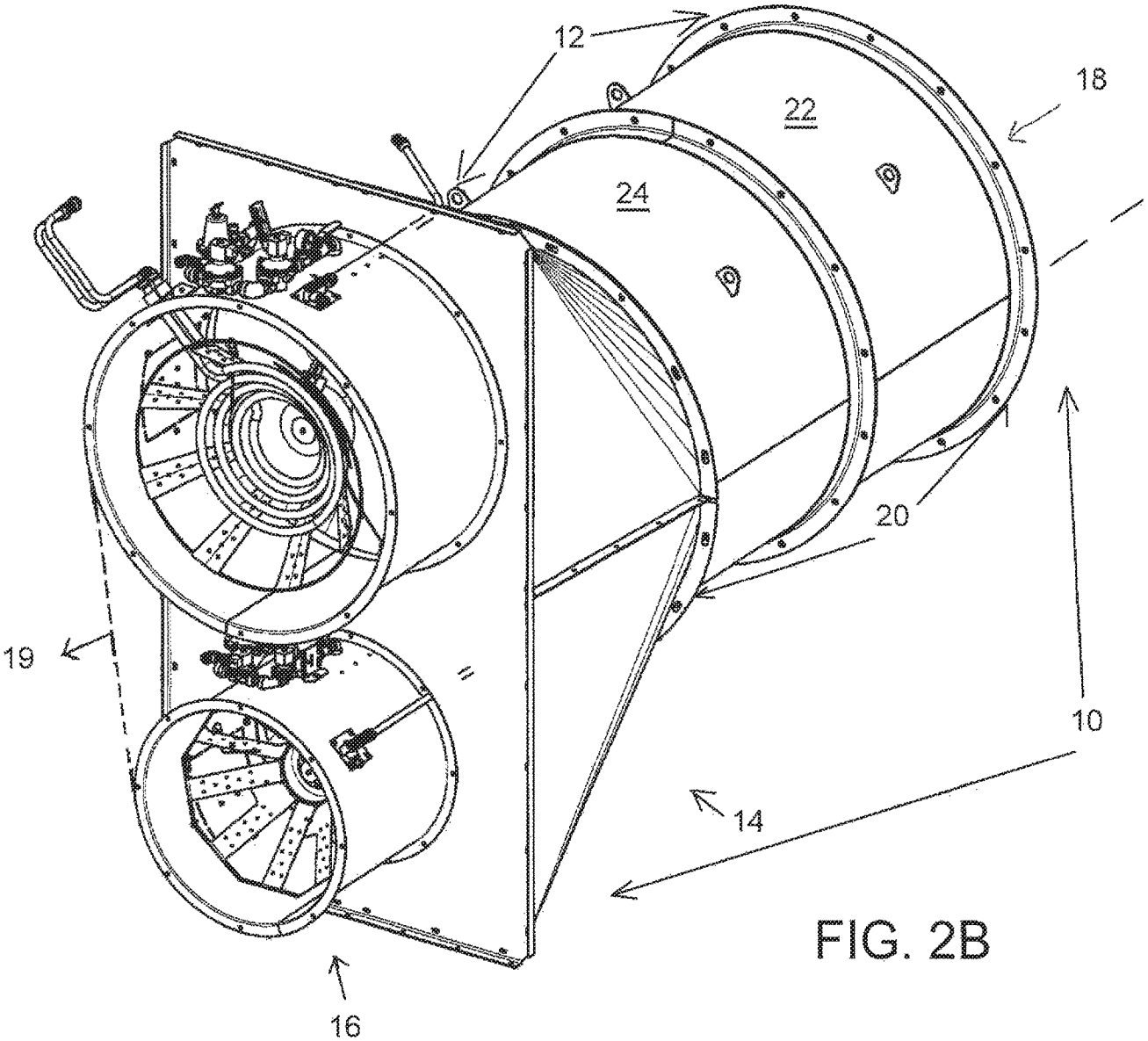
FIG. 2B is an isometric view of a dual burner dryer assembly of the dryer system of FIG. 1B.
Figure 3A:
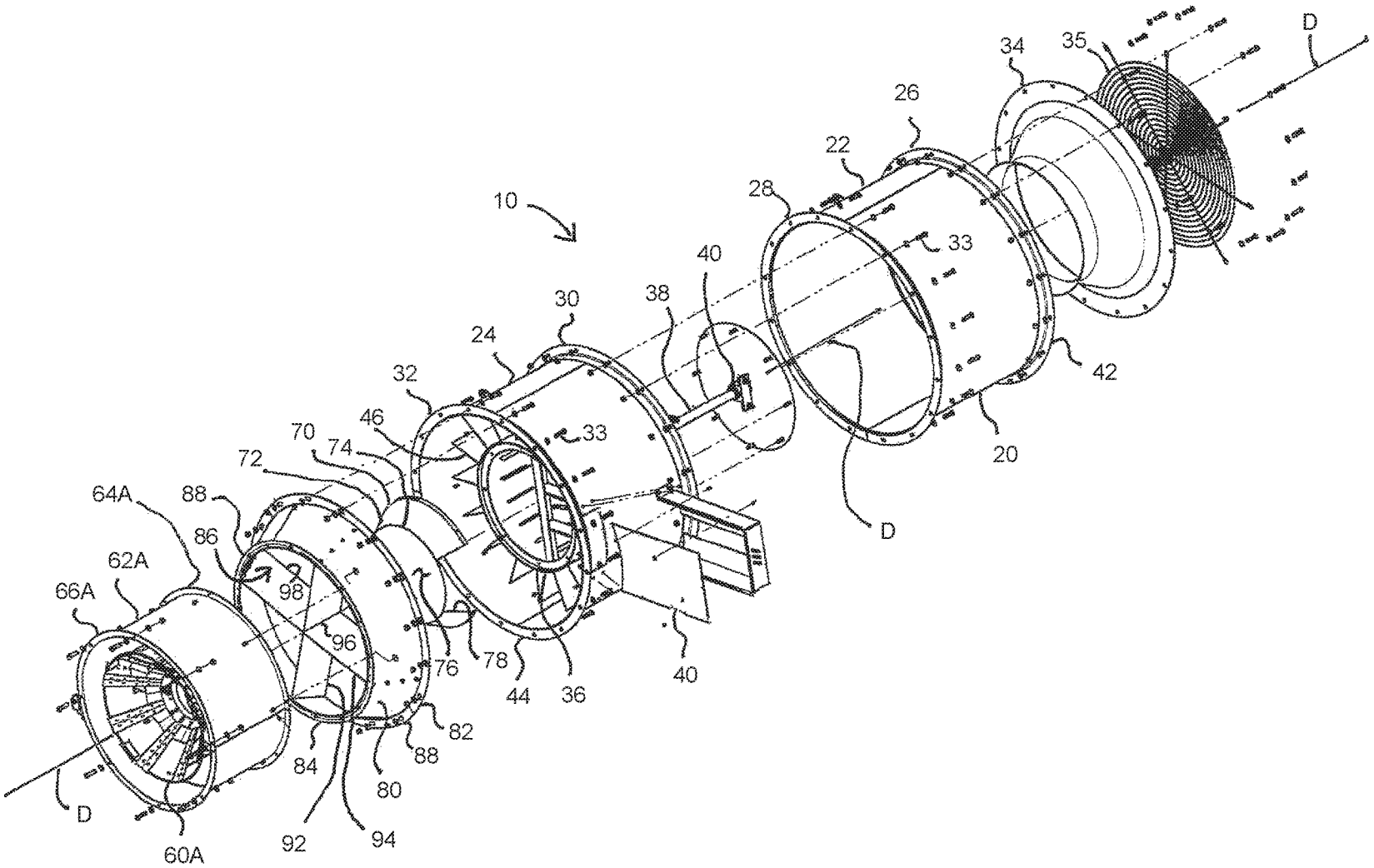
FIG. 3A is an exploded isometric view of the single burner dryer assembly of FIG. 2A.
Figure 3B:
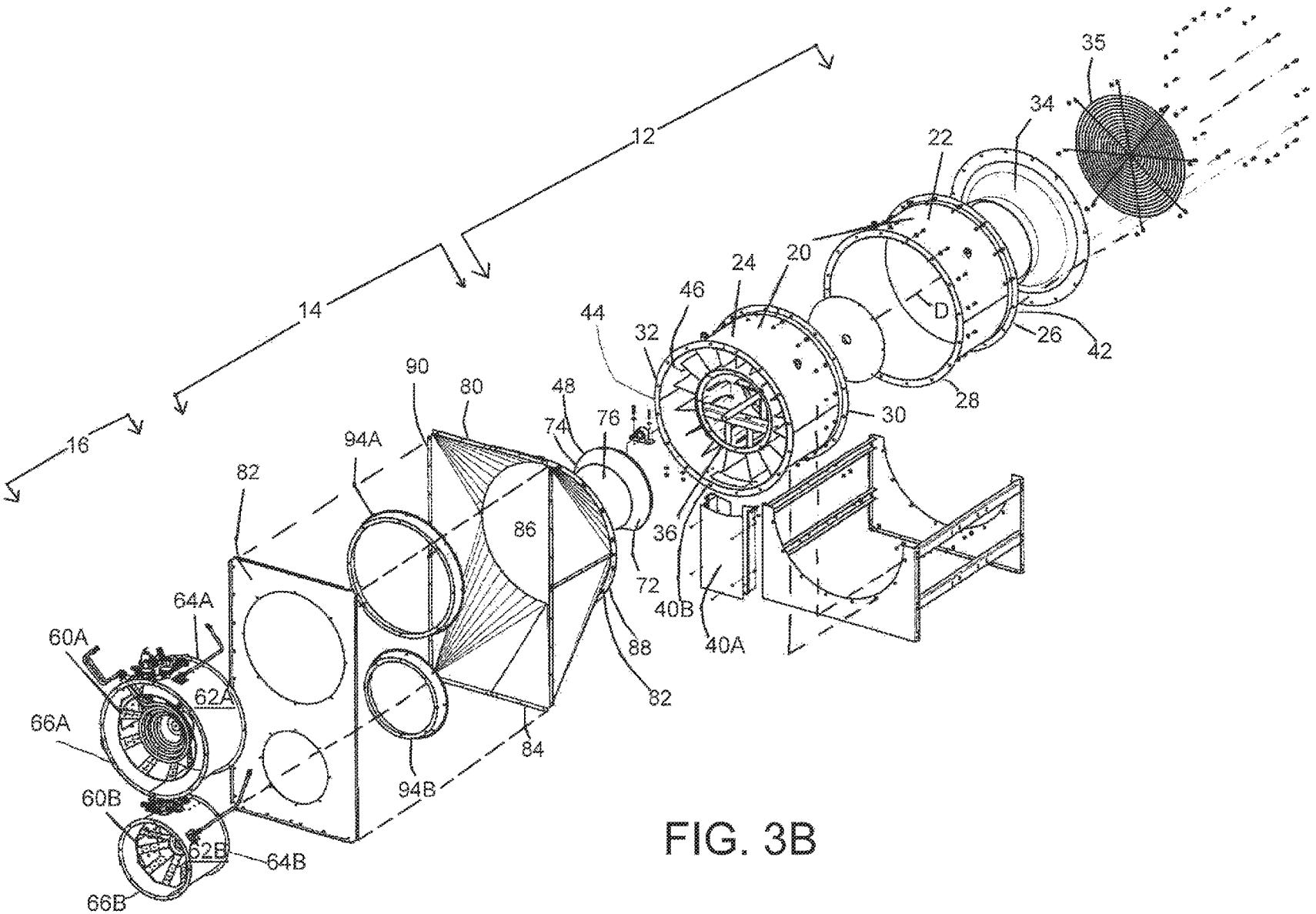
FIG. 3B is an exploded isometric view of the dual burner dryer assembly of FIG. 2B.
Figure 4A:
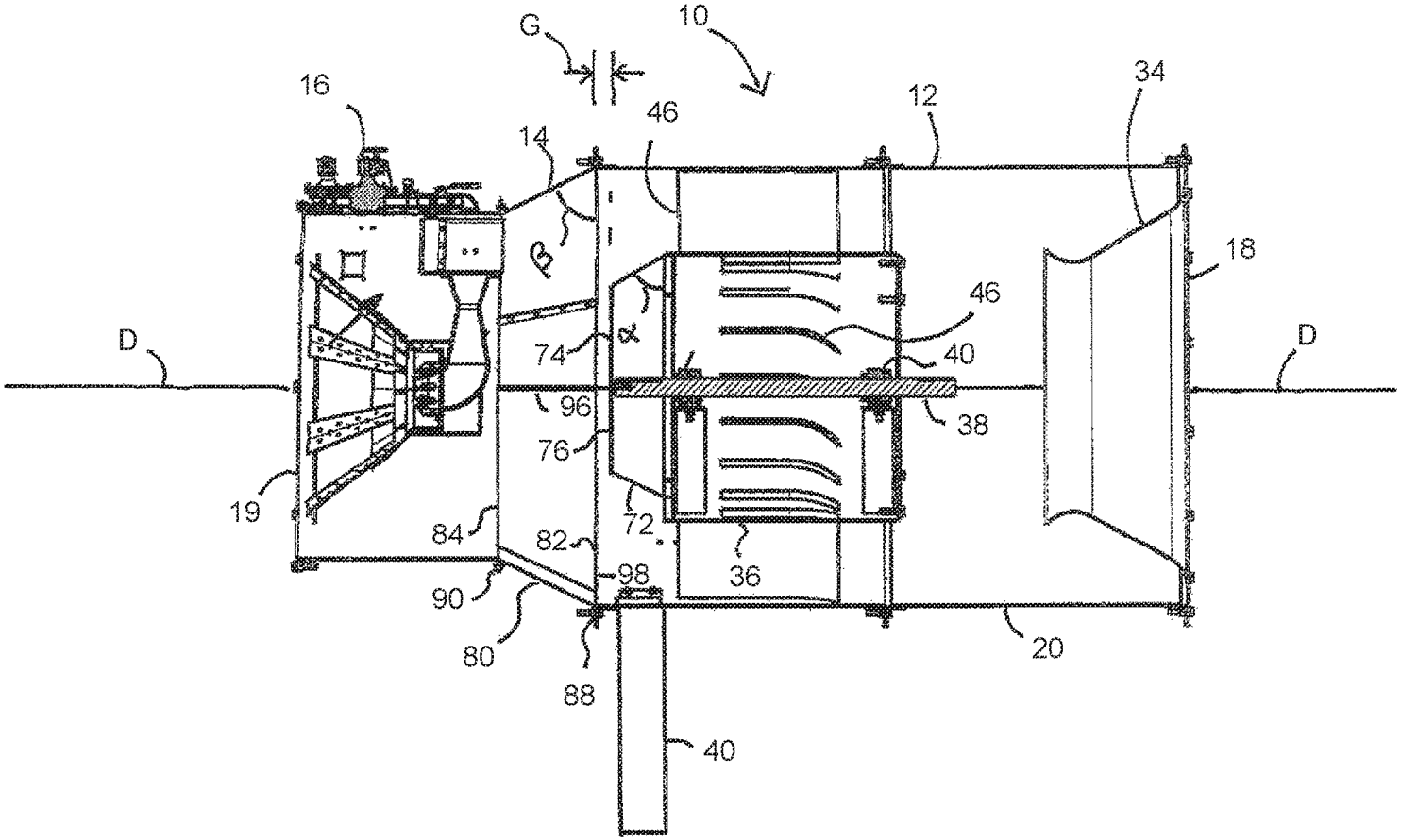
FIG. 4A is a side elevational cut-away view of the single burner dryer assembly of FIG. 2A.
Figure 4B:
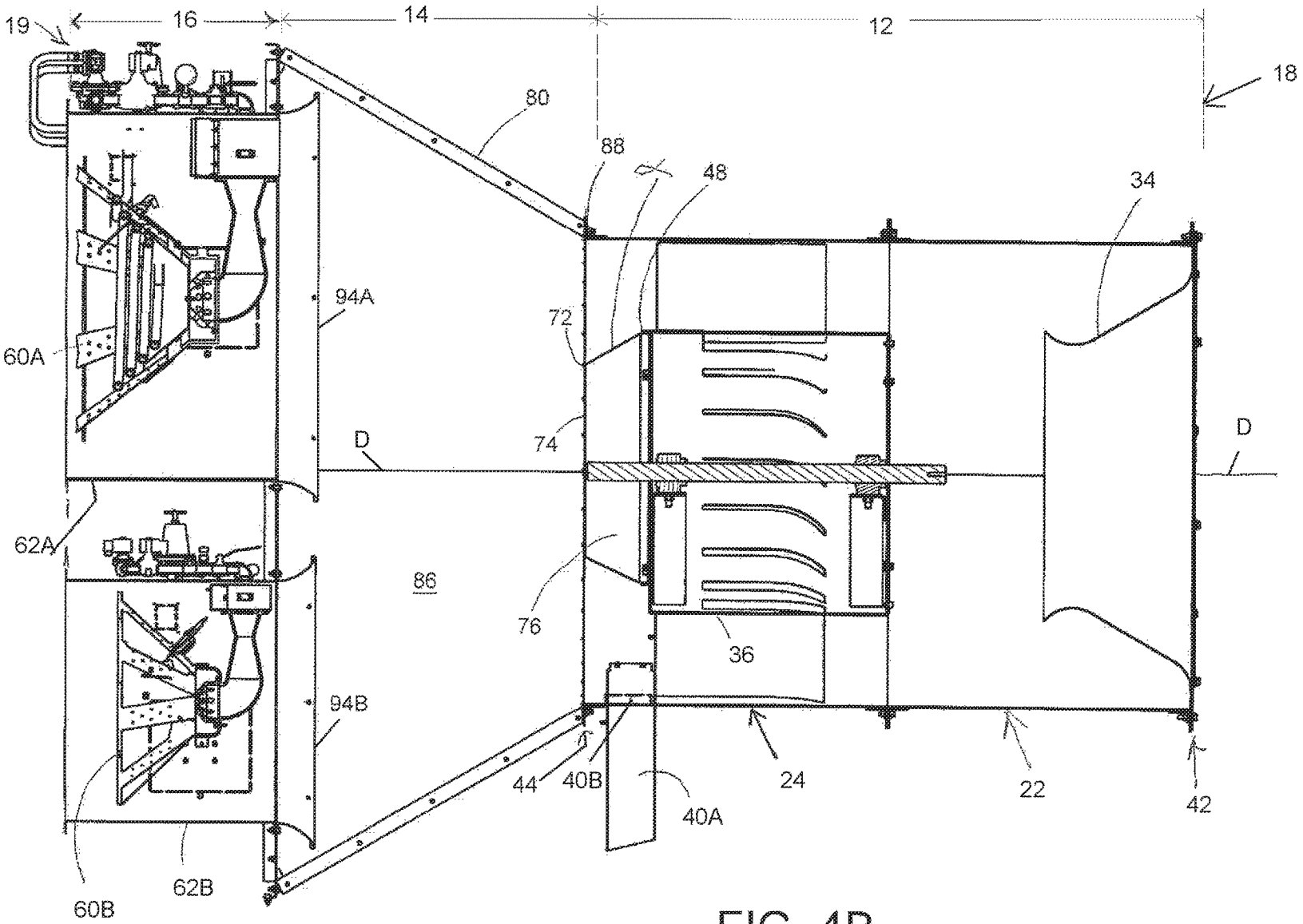
FIG. 4B is a side elevation cut-away view of the dual burner dryer assembly of FIG. 2B.

In the embodiment of FIG. 1B configured for dual burners 60A, 60B, the transition housing 80 has an upstream inlet 82A, having a circular configuration and proximate the fan apparatus 12 having a diameter approximately equal to the diameter of the outer fan housing 20 and a downstream outlet 84B, having a rectangular configuration proximate the heating assembly 16 and of a size suitable to encompass the two burner housings 62A, 62B. In one embodiment, the transition housing 80 transitions between a fan housing 20 with a diameter of about 54 inches (137 cm) to a rectangular housing outlet 84B which encompasses a first burner housing 62A diameter of about 42 inches (107 cm) and a second burner housing 62B diameter of about 28 inches (71 cm) or a total of 70 inches (178 cm). In this embodiment, the amount of airflow directed to each of the burners 60A, 60B is proportional to the diameter of the burner housings 62A, 62B, with the first burner 60A receiving approximately 60 percent of the airflow and the second burner 60B receiving approximately 40 percent of the airflow from the fan apparatus 12.

Just as in the single burner embodiment, the transition housing 80 has a substantially open middle section 86 for directing air from the fan apparatus 12 to the burner assembly 16 and is shown as being provided with a seventh flange 88 and an eighth flange 90. The seventh flange 88 is connected to the fourth flange 32 of the second can 24 of the fan apparatus 12 with suitable fasteners 33. In the dual burner configuration, the eighth flange 90 is connected to the perimeter of a transition housing outlet plate 82 with suitable fasteners. The transition housing outlet plate 82 is also shown as being configured to accept attachment of inlets 94A, 94B with suitable fasteners. The inlets 94A, 94B serve to facilitate enhanced airflow into the burner housings 62A, 62B and across the burners 60A, 60B. In one embodiment, the inlets 94A, 94B are of the type conventionally known as Venturi inlets. The burner housing flanges 64A, 64B serve the purpose of attaching the burner housings 62A, 62B to the transition housing outlet plate 82 with suitable fasteners. The burner housing flanges 66A, 66B serve the purpose of attaching the burner housings 62A, 62B to plenums, ductwork or other equipment of the dryer assembly 10.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings.

The invention claimed is:

1. A dryer assembly for directing heated air through an agricultural dryer, the dryer assembly comprising:

a fan apparatus configured to produce an airflow, the fan apparatus comprising a cylindrical outer fan housing;

a burner assembly comprising a burner and a cylindrical burner housing, the burner housing having a diameter that is smaller than a diameter of the fan housing, the fan apparatus and burner assembly forming a longitudinal agricultural dryer axis extending from a first end to a second end of the agricultural dryer;

an airflow transition mechanism positioned between the fan apparatus and the burner assembly configured to direct the airflow to the burner assembly, the airflow transition mechanism comprising:

an endcap positioned on a distal end of a bearing tube, the endcap having a sloped ring and an end plate, wherein the endplate has a diameter smaller than a diameter of the bearing tube and has a planer surface facing the burner assembly that is substantially perpendicular to the axis;

a transition housing having an upstream end proximate the fan apparatus, the first end having a first diameter, and a downstream end proximate the burner assembly, the downstream end having a second diameter, with the upstream first diameter being larger than the downstream second diameter, the transition housing having a substantially open middle opening for directing the airflow; and a first air-directing crossing member and a second air-directing crossing member, the first and second air-directing crossing members positioned in the middle opening of the transition housing, wherein the first and second crossing members extend through the axis.

2. The dryer assembly of claim 1 wherein the fan apparatus is a mixed-flow fan.

3. The dryer assembly of claim 2 wherein the mixed-flow fan comprises a cylindrical outer housing and a cylindrical bearing tube, wherein the bearing tube receives a shaft along portion of the axis of the dryer assembly.

4. The dryer assembly of claim 3 wherein the mixed-flow fan comprises a plurality of straightener vanes extending from an outer surface of the bearing tube toward the outer housing configured to direct airflow passing between the bearing tube and outer housing.

5. The dryer assembly of claim 1 wherein the diameter of the end plate is between 50%-80% of the diameter of the bearing tube.

6. The dryer assembly of claim 1 wherein the diameter of the downstream end is between about 60%-85% of the diameter of the upstream end.

7. The dryer assembly of claim 1 wherein the first crossing member is perpendicular with the second crossing member with the intersection of the two crossing members being collinear with the agricultural dryer axis.

8. The dryer assembly of claim 1 wherein ends of the first and second crossing members are spaced from the endplate of the endcap along the axis to form a gap, the gap having a distance of between about 0.25-1.0 inches (0.6-2.5 cm).

9. The dryer assembly of claim 1 wherein the first air-directing crossing member and the second air-directing crossing member are substantially planer members.

10. A dryer assembly for directing air through an agricultural dryer, comprising:

a fan apparatus forming a longitudinal axis extending from a first end to a second end of the dryer assembly, configured to produce an airflow;

a burner assembly comprising two burners, each burner with a cylindrical burner housing, each burner housing having a diameter smaller than a diameter of an outer fan housing;

an airflow transition mechanism positioned between the fan apparatus and the burner assembly and configured to direct the airflow to the two burner housings, the airflow transition mechanism comprising:

a transition housing having an upstream inlet proximate the fan apparatus, being circular in shape, and a downstream outlet proximate the burner assembly, being rectangular in shape, the transition housing having a substantially open middle for directing the airflow;

a transition housing outlet plate having a planer surface that is substantially perpendicular to the longitudinal axis of the fan apparatus; and two burner inlet devices, attached to the planer surface of the transition housing outlet plate and each burner inlet device with a diameter proportionally equal to the diameter of an adjacent burner housing of the two burner housing of the burner assembly.

11. The dryer assembly of claim 10 wherein the fan apparatus is a mixed-flow fan.

12. The dryer assembly of claim 11 wherein the mixed-flow fan comprises:

a cylindrical outer housing;

a cylindrical bearing tube, wherein the bearing tube receives a shaft along a portion of the axis of the fan apparatus; and an endcap positioned on a distal end of the bearing tube, the endcap having a sloped ring and an end plate, wherein the endplate has a diameter smaller than a diameter of the bearing tube and has a planer surface that is substantially perpendicular to the longitudinal axis of the dryer assembly.

13. The dryer assembly of claim 12 wherein the mixed-flow fan comprises a plurality of straightener vanes extending from an outer surface of the bearing tube toward the outer fan housing configured to direct airflow passing between the bearing tube and outer fan housing.

14. The dryer assembly of claim 12 wherein the diameter of the end plate is between 50%-80% of the diameter of the bearing tube.

15. The dryer assembly of claim 10 wherein each of the burner inlet devices is a Venturi inlet device.

16. The dryer assembly of claim 10 wherein the burner assembly is comprised of two burners of equal diameter.

17. The dryer assembly of claim 10 wherein the heating assembly is comprised of two burners with a diameter ratio of 60/40.

* * * * *